US006253450B1

(12) United States Patent
Woodall et al.

(10) Patent No.: US 6,253,450 B1
(45) Date of Patent: Jul. 3, 2001

(54) LINE CHARGE FABRICATION AND PROCEDURES

(75) Inventors: Robert Woodall, Lynn Haven; Felipe Garcia, Panama City; Gilberto Irizarry, Panama City Beach, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/257,142

(22) Filed: Feb. 23, 1999

Related U.S. Application Data

(63) Continuation-in-part of application No. 09/012,932, filed on Jan. 24, 1998, now Pat. No. 6,205,903, and a continuation-in-part of application No. 08/944,049, filed on Sep. 12, 1997, now Pat. No. 5,932,835, and a continuation-in-part of application No. 09/030,518, filed on Feb. 23, 1998, now abandoned.

(51) Int. Cl.[7] ..... B23P 21/00
(52) U.S. Cl. ..... 29/771; 29/281.5
(58) Field of Search ..... 29/1.1, 1.11, 1.2, 29/281.5, 771, 779, 787

(56) References Cited

U.S. PATENT DOCUMENTS 1,532,285 * 4/1925 Watson ..... 29/779
4,967,636 * 11/1990 Murray et al. ..... 89/1.13
5,467,520 * 11/1995 Nunez et al. ..... 29/564.6
5,959,233 * 9/1999 Garcia et al. ..... 89/1.13
5,960,732 * 10/1999 Peterson ..... 114/244

* cited by examiner

*Primary Examiner*—S. Thomas Hughes
*Assistant Examiner*—Essama Omgba
(74) *Attorney, Agent, or Firm*—Harvey A. Gilbert; Donald G. Peck

(57) ABSTRACT

An assembly line and procedure fabricate more reliable explosive line charges by reducing many of the human error factors affecting assembly. The assembly line and procedures maintain proper grenade spacing, eliminate twisting of nylon lines and detonating cord which degrade performance, provide for proper clamping of lines and connector elements, provide for slack management of the explosive detonating cord and the lines, control the tolerances at the detonating cord to connector interfaces, and provide for the end of line packing of the explosive line charge.

The assembly line and procedures additionally are configured to allow for the rapid inspection and adjustment of: length of lines, length of detonating cord, spacing of grenades, amount of twist in the lines and detonating cord, pressure feed to the pneumatic clamping apparatus, the clamping forces exerted on the clamped lines/clamps/grenades, the alignment of the clamps and buckles with the grenades, the alignment and gap condition of the detonating cords and boosters with respect to the connector elements, and the spacing and number of grenades in the line charge. The assembly line and procedures also eliminate the hazards of explosive spark and static electricity.

14 Claims, 4 Drawing Sheets

LINE CHARGE FABRICATION AND PROCEDURES

CROSS REFERENCE TO RELATED APPLICATIONS

This is a continuation in part of copending U.S. patent applications entitled "Reliable and Effective Line Charge System" by Felipe Garcia et al., U.S. Patent and Trademark Office Ser. No. 09/012,932 (NC 78,433), filed Jan. 24, 1998, U.S. Pat. No. 6,205,903, "Line Charge Insensitive Munition Warhead" by Felipe Garcia et al., U.S. Patent and Trademark Office Ser. No. 08/944,049 (NC 78,448), filed Sep. 12, 1997, U.S. Pat. No. 5,932,835 and "Line Charge Connector" by Felipe Garcia et al., U.S. Patent and Trademark Office Ser. No. 09/030,518 (NC 78,635), filed Feb. 23, 1998, abandoned and incorporates all references and information thereof by reference herein.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to fabrication of explosive line charges. In particular, this invention relates to an assembly system and procedure that minimize and eliminate many problems associated with line charge fabrication that can degrade performance.

The use of contemporary explosive line charges to breach an obstacle and mine laden area can be an inherently unreliable proposition. Line charges are expected to perform under extremely adverse conditions and accomplish difficult missions during combat. The line charges often are subjected to numerous abuses as they are transported to and emplaced in the field. In addition, they must survive intense self-destructive forces as they are deployed by rockets or other highly accelerating launch systems. Consequently, a considerable number of line charges simply do not fly to where they should, or some components do not work right or break apart. As a result, detonations are ineffective or interrupted throughout the lengths of the line charges, and they fail to clear a path through the obstacles and mines.

Many of these failures can be traced to the components used and the procedures followed during the assembly of these components into line charges. Failures have been created by nonuniform arrangements of the components and nonuniform interconnections among the components. These nonuniformities unevenly distribute the forces created during deployment and compromise reliability.

Thus, in accordance with this inventive concept, a need has been recognized in the state of the art for a means for and method of assembling explosive line charges that have greater reliability.

SUMMARY OF THE INVENTION

The present invention is directed to providing a system and procedure for assembling explosive line charges and includes tension exerting means that exerts tension on elongate lines, and holding means that holds a grenade secured to the lines to resist the tension exerted by the tension exerting means. Clamping means that clamps grenades to the lines is interposed between the tension exerting means and the holding means, and a connector securing means that secures connector elements to ends of the lines is interposed between the tension exerting means and the holding means. Grenade spacing means spacing the clamped grenades predetermined distances apart in wells receives grenades clamped to the lines, and slack creating means is interposed between each of the wells to create slack lengths of detonating cord between the spaced clamped grenades. Detonating cord securing means secures opposite end portions of the detonating cord to the connector elements.

An object of the invention is to provide means for and method of manufacturing reliable explosive line charges used for clearing obstacles and mines.

Another object of the invention is to provide means for and method of manufacturing line charges that reduce problems associated with fabrication that can degrade performance.

Another object of the invention is to provide means for and method of manufacturing line charges that ensures proper grenade spacing.

Another object of the invention is to provide means for and method of manufacturing line charges that tensions lines to minimize slack and provide for accurate grenade spacing.

Another object of the invention is to provide a stripe along each line to visually indicate unwanted twisting of the lines during each phase of the fabrication process.

Another object of the invention is to provide means for and method of manufacturing line charges using pneumatic air tools for repeatable, precalibrated clamping and cutting of band and connector clamps to reduce human errors associated with human powered clamping tools.

Another object of the invention is to provide means for and method of manufacturing line charges using a grenade working jig to clamp lines to properly spaced grenades.

Another object of the invention is to provide means for and method of manufacturing line charges using a connector jig to clamp lines to connector elements.

Another object of the invention is to provide means for and method of manufacturing line charges using hand held gauges to make on the spot inspections of lines, clamps, grenades, and connector elements.

Another object of the invention is to provide means for and method of manufacturing line charges having a pack out table and cast plug structure that permits proper alignment of and tolerances for the detonating cord to improve reliability.

Another object of the invention is to provide means for and method of manufacturing line charges having a pack out table with humps to manage slack in the detonating cord and reduce twisting of lines and detonating cord as they are packed.

Another object of the invention is to provide means for and method of manufacturing line charges that are lightweight and maintain critical spacing distances or tolerances among components that are essential for their effectiveness.

Another object of the invention is to provide means for and method of manufacturing reliable line charges that have little, if any, strain loading of the detonating cord used to detonate the explosive grenades.

Another object of the invention is to provide means for and method of manufacturing line charges that reduce self-destructive stresses and strains during deployment and maintain spacing among the grenades.

These and other objects of the invention will become more readily apparent from the ensuing specification when taken in conjunction with the appended claims.

DESCRIPTION OF THE PREFERRED EMBODIMENT

Figure 1:
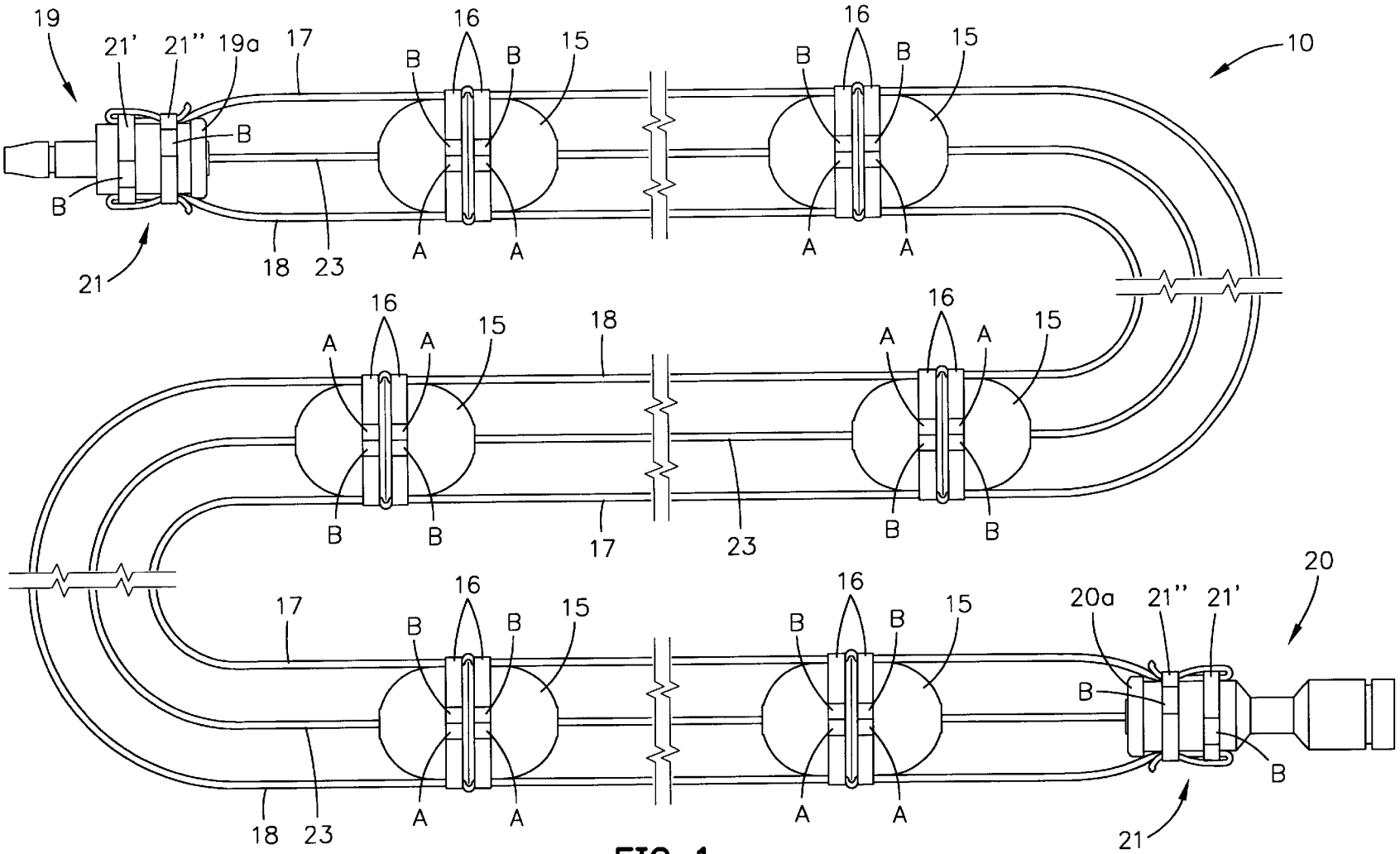
FIG. 1 shows an explosive line charge fabricated in accordance with this invention.

Referring to FIG. 1, explosive line charge 10 has been fabricated in accordance with the novel assembly system and procedure of this invention. Accordingly, such a line charge may be launched and detonated to reliably clear a lane through obstacles and mines.

Line charge 10 includes spaced-apart explosive warheads or grenades 15 that are each appropriately connected by pairs of band clamps 16 to elongate flexible strength members 17 and 18 extending from one end to the other. Typically, line charge 10 may have up to 60 grenades 15, but only a few are shown to avoid needless redundancy.

Strength members 17 and 18 are secured at their opposite ends to male connector element 19 or female connector element 20 by pairs of connector clamps 21' and 21". Detonating cord 23 also extends between the connector elements and freely passes through axial bores 15*a* in all grenades 15. When detonating cord 23 is detonated by an exploding booster unit (not shown) at one end of line charge 10, all grenades 15 are detonated virtually simultaneously to clear a safe lane. Strength members 17 and 18, detonating cord 23, grenades 15, connector elements 19 and 20, and clamps 16, 21' & 21" are fully described in the patent applications referenced above.

Line charge 10 is deployed to lie across an area and is detonated to clear a lane through the area. One way to accurately deploy line charge 10 is to secure a rocket motor to a connector element at one end and an anchoring device to the other connector element at the other end. The anchoring device may be a fixed solid structure at the near side of the area, a drogue chute, or a combination of the two, for example. The rocket is aimed to cross the obstructed area, and when it is fired, it accelerates rapidly and pulls line charge 10 along with it. Shortly after it lands, line charge 10 is detonated.

Several line charges 10 may be coupled together in series by connecting mating portions of male and female connector elements 19 and 20. Thus, longer or shorter lanes may be cleared. Otherwise, a single line charge 10 having, for example, 60 grenades is used to breach an area, and, as mentioned above, male and female connector elements 19 and 20 are coupled to other elements, such as the rocket motor at one end and the anchoring device at the other end.

Figure 2:
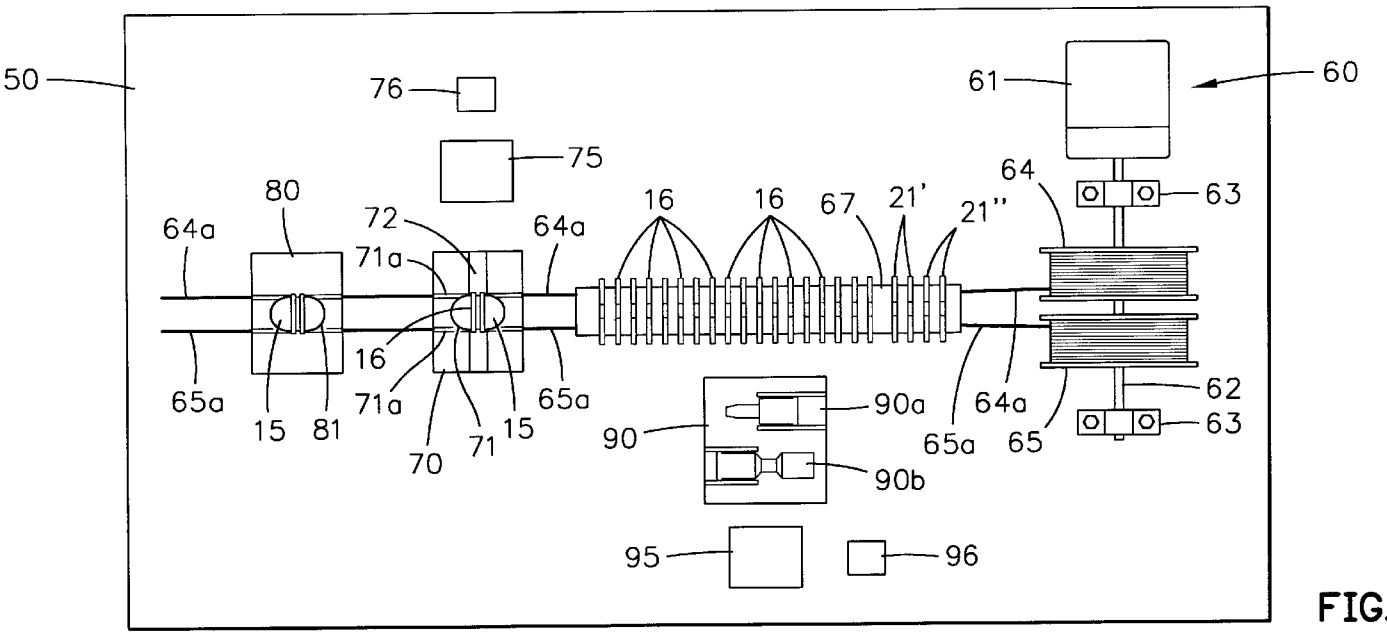
FIG. 2 schematically shows the assembly line table.
Figure 3:
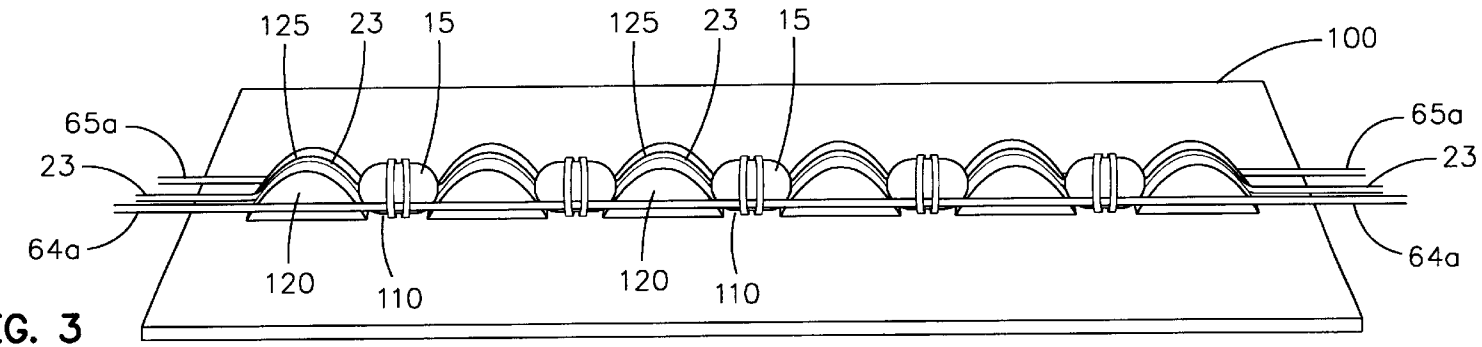
FIG. 3 schematically shows the pack out table.

Referring to FIGS. 1, 2, and 3, line charge 10 is assembled on assembly table 50 and pack out table 100. Strength members 17 and 18 are formed from nylon lines 64*a* and 65*a* placed on opposite sides of each grenade 15 that is spaced apart from one other a distance that optimizes their effectiveness. Lines 64*a* and 65*a* are clamped and crimped in place around grenades 15 by band clamps 16. Detonating cord 23 freely and continuously extends through axial bores 15*a* in grenades 15. Opposite ends of lines 64*a* and 65*a* are clamped to the outside of male and female connector elements 19 and 20 with pairs of connector clamps 21' and 21". Opposite ends of detonating cord 23 are connected within male and female connector elements 19 and 20. Both ends of the cord are secured within the connectors with threaded end caps 24, washers 25, nylon plates 26, nylon cups 27, and cast plugs 28 as explained below.

Referring to FIG. 2, assembly table 50 supports air driven motor assembly 60. Motor assembly 60 includes an air motor 61 and shaft 62 having journals in a pair of bearing mounts 63. Motor 61, shaft 62, and bearing mounts 63 are sufficiently robust to exert and withstand the torsional and tensile loads that accompany the fabrication procedure of this invention.

Shaft 62 has a pair of spools 64 and 65 secured to it. Spools 64 and 65 respectively support lengths of nylon line 64*a* and 65*a* which are to become strength members 17 and 18. Motor 61 is selectively controllable to tension measurable lengths of line 64*a* and 65*a* as they are pulled from spools 64 and 65. It preferably has integral instrumentation that indicates the lengths payed-out and the amount of torque it exerts so that lengths of line and tension on lines 64*a* and 65*a* can be set, monitored, and maintained. These payed-out lengths may be made to equal the desired separation between adjacent grenades 15 and a connector 19 or 20 and adjacent grenade 15.

One such motor that works is the model 3R5075 air motor manufactured by Ingersoll Division. Other air motors could be used or electrical motors might be selected. Separate torque and tensile gauges and other measuring tools also could be used.

Coiled nylon lines 64*a* and 65*a* are each marked via a red painted stripe or thread running longitudinally along their sides. As lines 64*a* and 65*a* are pulled out from spools 64 and 65, the stripes are visually inspected to make certain that the lines are not twisted. This visual inspection continues throughout the assembly procedure.

Nylon lines 64*a* and 65*a* extend from motor assembly 60 and through elongate assembly table tube 67. Tube 67 is secured above the surface of table 50 via a bracket, (not shown) to guide lines 64*a* and 65*a* as they are payed-out from spools 64 and 65. Grenade band clamps 16 and connector clamps 21' and 21" are temporarily stored on tube 67 prior to being used in pairs to clamp separate grenades 15 or connector elements 19 and 20 onto lines 64*a* and 65*a*.

The individual grenades 15 are secured to nylon lines 64*a* and 65*a* one at a time in grenade working jig 70. Grenade working jig 70 is secured to table 50 and may have two essentially identical halves releaseably held together. Only one half, a bottom half, is shown in FIG. 2.

Each half, top or bottom, has recess 71 that is shaped to fit about one side of grenade 15, longitudinal channels 71*a* to accommodate lines 64*a* and 65*a*, and lateral slots 72 to allow the clamping, or crimping of a pair of band clamps 16 by, for example, tandem air tool 75. Optionally, grenade working jig 70 may be a single piece having a single recess 71 that is appropriately sized to fit about a sufficient portion of grenade 15 to hold it while two grenade band clamps 16 are properly placed in slots 72 and crimped by tandem air tool 75. Pairs of band clamps 16 are moved from tube 67 and fitted about grenade 15 through slots 72. Tails C of the two parallel band clamps 16 extend into slots 72 where they are engaged by tandem air tool 75.

Tandem air tool 75 tightens band clamps 16 in grenade working jig 70 so that band clamps 16 clamp onto grenade 15 and both lines 64*a* and 64*b*. Air tool 75 has appropriate gauges to indicate proper clamping force is being exerted by band clamps 16. A typical tool that may be selected for tandem air tool 75 is the model T 350 manufactured by Band-It Corporation of Denver Colo. It may be calibrated with gauges 76 in accordance with its instructional procedure known as "Banding Machine Calibration with A500".

Optionally, other manual, or hand-held tools, could be used, and, in this case, gauges 76 monitor the clamping forces. In either case, air tool 75 or manual gauges 76 indicate that band clamps 16 grip lines 64*a* and 65*a* with the right amount of force that will both hold grenades 15 in place during deployment, yet not compromise the strength of the lines by overly crimping or cutting them.

Tension on lines 64*a* and 65*a* is relaxed via motor 61, and grenade 15 which has just been secured to lines 64*a* and 65*a* in grenade working jig 70 is moved forward and fitted into holding jig 80. Holding jig 80 has recess 81 configured and sized to receive grenade 15 that has just been connected to lines 64*a* and 65*a*. Holding jig 80 may directly engage lines 64*a* and 65*a* to resist the tensile forces exerted by motor 61.

Tension on lines 64*a* and 65*a* is reapplied via motor 61, and holding jig 80 properly tensions and orients lines 64*a* and 65*a* while the next grenade 15 is secured to them in jig 70. This procedure may be repeated until all grenades are secured to lines 64*a* and 65*a*.

After the first grenade 15 has been clamped onto lines 64*a* and 65*a*, grenade working jig 70 is removed from table 50 and replaced with connector jig 90 that has appropriately configured recesses 90*a* and 90*b* to respectively receive and engage a selected male connector element 19 or female connector element 20. Male-female connector jig 90 is shown in its stand-by position at the lower right in FIG. 2.

The first grenade 15 is placed into recess 81 of holding jig 80. Lengths of lines 64*a* and 65*a* that were measured and extended before the first grenade 15 was attached at the beginning of the fabrication procedure are brought back to lie across connector jig 90. By examination of the red threads, lines 64*a* and 65*a* are prevented from anomalies, such as being twisted, and they are positioned properly.

Figure 5:
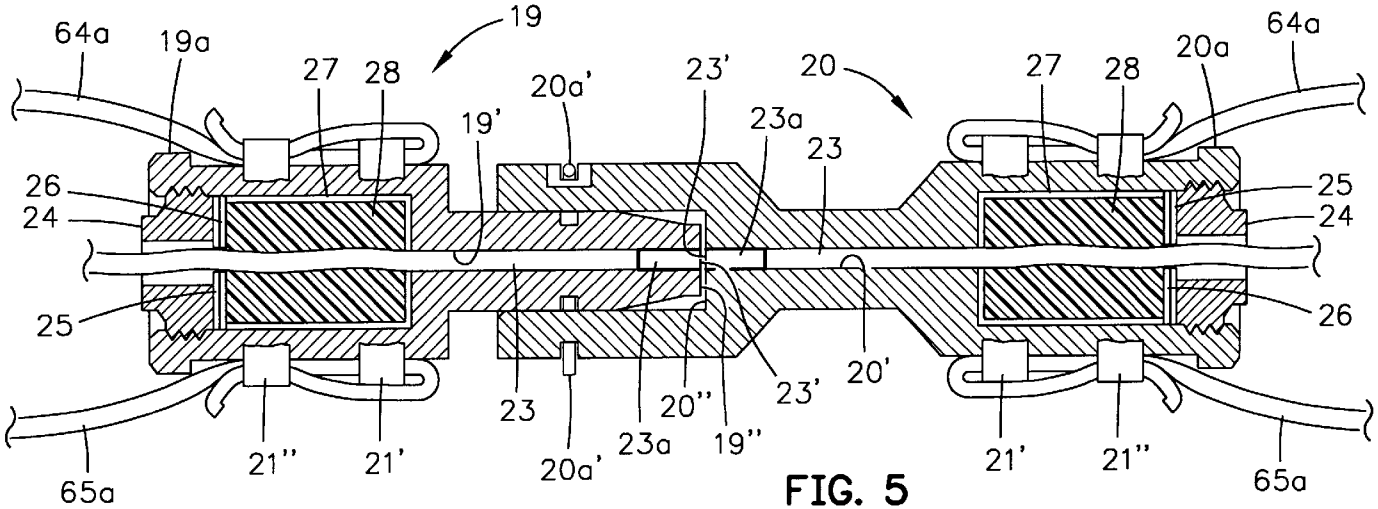
FIG. 5 is a cross-sectional side view of male and female connector elements showing: their interconnection by a spring clip; ends of detonating cords within the critical separation distance; engagement of male and female connector elements and lines by connector clamps; and threaded end caps, washers, nylon plates, nylon cups, and cast plugs holding end portions of detonating cords in connector elements.

Referring to FIGS. 2 and 5, two connector clamps 21' and 21" are placed over lines 64*a* and 65*a* on the selected connector element 19 or 20. The lines then are brought back over one of the clamps and fitted under the other clamp. Care must be taken that there is no twisting of lines 64*a* and 65*a* and that one of the clamps is slid adjacent shoulders 19*a* or 20*a* of the selected connector element. Next, air tool 95 engages tails C of connector clamps 21' and 21" and tightens them one at a time in connector jig 90. This clamps connector clamps 21' and 21" onto the selected connector element 19 or 20 and both lines 64*a* and 65*a*.

Air tool 95 may have appropriate gauges to indicate proper clamping of connector clamps 21' and 21". However, hand-held gauges 96 also can be applied to make certain that connector clamps 21' and 21" grip lines 64*a* and 65*a* with the right amount of force that will both engage connector elements 19 and 20 during deployment, yet not compromise the strength of the lines. Tandem air tool 75 could be used as air tool 95, but it would have to be calibrated differently.

After all grenades 15 are clamped, the other connector element 19 or 20 is mounted in essentially the same procedure at the other end of line charge 10 on other measured lengths of lines 64*a* and 65*a*. Of course, the other recess 90*a* or 90*b* in connector jig 90 would be used. The attachment of the male and female connectors is elaborated on in the above referenced application entitled, "Line Charge Connector."

This partially completed line charge 10 is taken from assembly table 50 to pack out table 100 of the assembly line system. All grenades 15 are placed in sequential spaced-apart recesses, or wells 110 provided in pack out table 100. Each well 110 is located between adjacent hump-shaped contoured surfaces 120 which extend above pack out table 100, and each hump 120 is provided with a longitudinal groove 125. Lines 64*a* and 65*a* are placed to lie essentially parallel on opposite sides of humps 120. This permits visual inspections that there are no twists in the partially assembled line charge. Detonating cord 23 is passed through each axial bore 15*a* in each grenade 15 and through each groove 125 that positions detonating cord 23 over each hump 120. Thus, detonating cord 23 is given sufficient slack so that it is not subjected to failure inducing strains during deployment of line charge 10.

Figure 6:
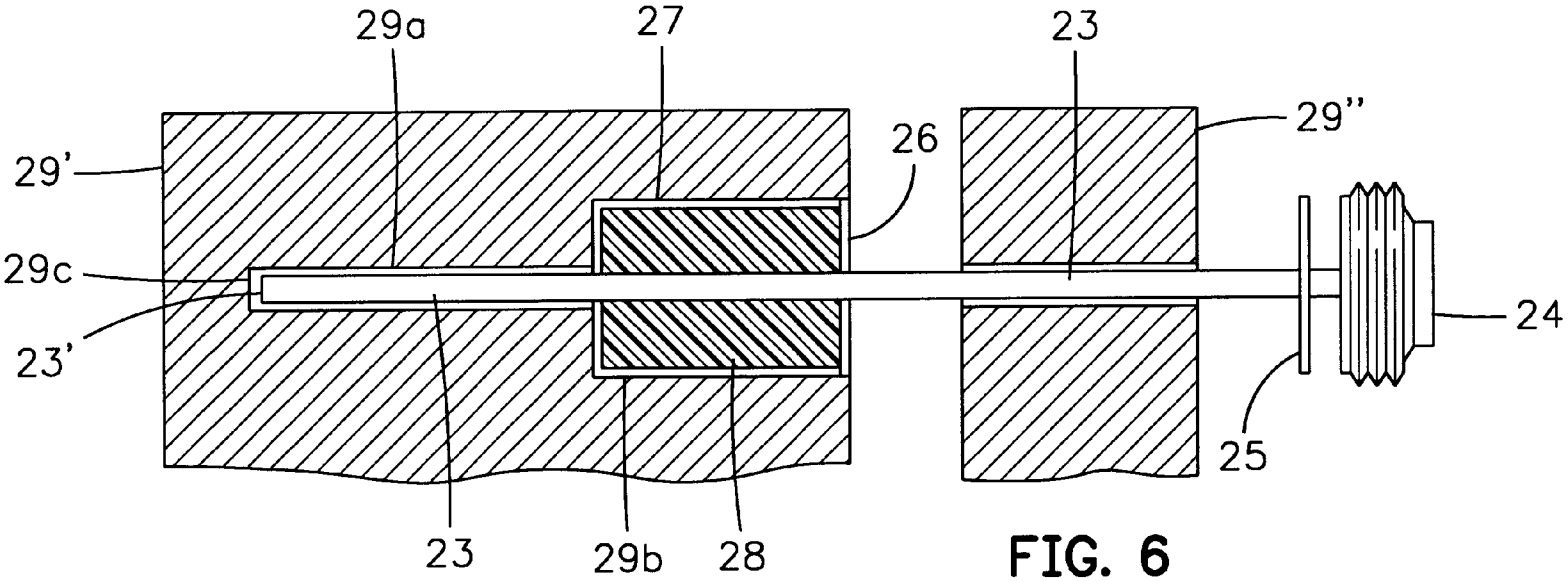
FIG. 6 is a cross-sectional view of two mold parts just prior to being held together with mirror-image mold parts to cure a cast plug.

Referring to FIGS. 5 and 6, detonating cord 23 is placed to extend through bores 19' and 20" in connector elements 19 and 20, respectively. Detonating cord 23 is secured at its opposite ends in connector elements 19 and 20 using threaded end caps 24, washers 25, disc-shaped nylon plates 26, and cast plugs 28 in nylon cups 27. End cap 24, washer 25, nylon plate 26, and nylon cup 27 each have holes sized to snugly pass an end portion of detonating cord 23 through them. Next, end cap 24, end washer 25, and nylon plate 26 are slid back away from nylon cup 27 and the end portion of detonating cord 23.

Nylon cup 27 and each end portion of detonating cord 23 are placed into two mold parts 29' and 29" just prior to being held together with mold parts that are mirror-images of parts 29' and 29" for curing cast plug 28. Mold part 29' and its mirror image are provided with elongate portion 29*a* sized to snugly receive the end portion of detonating cord 23 and explosive booster 23*a* which may have been fitted onto detonation cord 23. Mold part 29' and its mirror image also have casting chamber 29*b* sized to receive thin walled nylon cup 27 that will be closed by nylon plate 26 to form plug 28. Elongate portion 29*a* extends a critical length to accommodate the end portion of detonating cord 23 and booster 23*a* so that end 23' of detonating cord 23 will bottom out against wall 29*c*.

Casting of plug 28 occurs within cup 27 and plate 26 and is directly on detonating cord 23. A suitable release agent, such as silicone grease, is coated on the internal surfaces of mold parts 29' and 29" and their mirror-image parts. Accordingly, plate 26, cup 27, cast plug 28 and the end portion of detonating cord 23 can be removed after the mixed casting agent has cured. Cast plug 28 is firmly adhered to detonating cord 23, however, to retain and precisely position end 23' of detonating cord 23 in either male or female connector 19 or 20.

Nylon cup 27 in casting chamber 29*b* of mold part 29' and its mirror image are filled with a suitable casting agent, such as the casting agent commercially marketed under the trademark Epoxy. Over flow, or excess casting agent is wiped away and plate 26 closes cup 27. Mold parts 29' and 29" and their mirror image parts are brought together and held there by a 30 to 35 pound force while the casting material cures. After a curing period of about 24 hours, plug 28 is formed to precisely position end 23' of detonating cord 23.

This precise positioning of ends 23' of detonating cords 23 or boosters 23*a* with respect to the inner ends 19" and 20" of male or female connector elements 19 or 20 is within 0.010 inches and is critical to the improved reliability of line charge 10. Depths of ends 23' of detonating cords 23 or boosters 23*a* are checked with a micrometer to be flush with or no more than 0.010 inches below inner ends 19" or 20" of connector elements 19 or 20. Shims or spacers may be added, or a smaller washer 25 (or no washer) may be used to meet this requirement.

In other words, when connector elements 19 and 20 (or other coupling devices that mate with them) are coupled together, ends 23' of detonating cords 23 or boosters 23*a* need to be abutting or nearly abutting within a critical distance or separation so that detonation between adjacent detonating cords 23 is assured. The critical distance between these coupling elements must not be exceeded to transfer detonation between them.

This casting procedure is essentially the same for both connector elements. After curing, end caps 24 are threaded into connector elements 19 and 20. An inspection gauge is used to check to see that the critically close spacings between ends 23' of the detonating cords 23 are maintained so that uninterrupted detonation is assured.

Plugs 28 attached to ends of detonating cord 23 are subjected to tensile, or pull tests to verify adherence. Pull tests are made to check to see that the cords will not separate from the connectors or that the critical distances between adjacent ends 23' of abutting detonating cords 23 will not be exceeded. The end portion of detonating cord 23 having nylon cup 27 filled with plug 28 is inserted into a test connector. The test connector has virtually the same internal dimensions as either male or female connector element 19 or 20, and it is secured in a vise. End cap 24 is threaded into the test connector, and the top of detonating cord 23 is marked where it extends through end cap 24. Detonating cord 23 is wrapped three to four times around a machine, such as a dynamometer that exerts a measured tensile force. A tensile force of about 80+/−2 pounds is applied. A visual check of the mark on detonating cord 23 where it comes through end cap 24 indicates slippage, if any, of nylon cup 27 or plug 28 on detonating cord 23. If the mark indicates that nylon cup 27 and plug 28 slip, then detonating cord 23 is rejected and will be returned for repair. If two slipping nylon cups 27 and plugs 28 are on opposite end portions of detonating cord 23, pull the detonating cord from the slipping nylon cup and remove the cord.

Now detonating cord 23 that has passed the pull test is marked about one quarter of an inch on each side of each grenade 15. This gives a visual indication of proper detonating-cord-to-grenade alignment for proper management of the detonating cord during pack out of line charge 10 in its backpack. A backpack is the most likely transport and stowage case for line charge 10 and will be discussed below.

Figure 4:
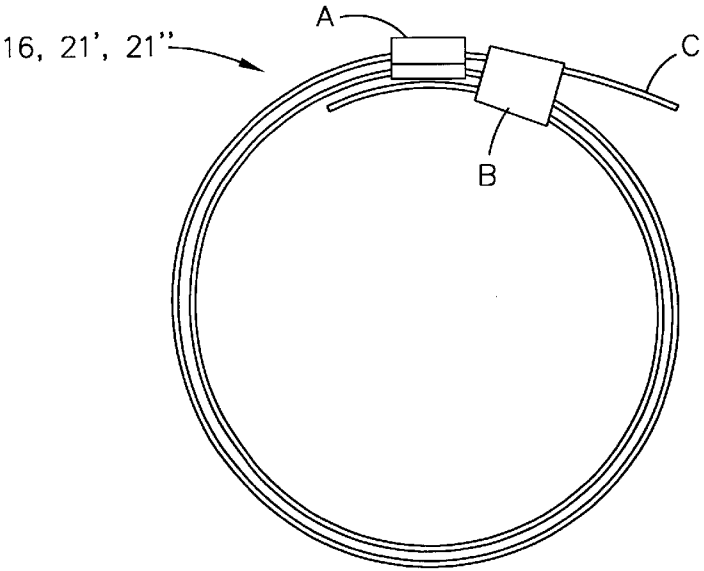
FIG. 4 is a side view of a band or connector clamp showing the clip, buckle, and tail.

At the start of the assembly procedure tandem air tool 75 is calibrated so that band clamps 16 properly engage lines 64*a* and 65*a* with the proper tension, or clamping force. Tandem air tool 75 and other elements used in assembly of line charge 10 also are checked for proper operation parameters between successive assemblies of additional line charges to assure quality control. This calls for clamping band clamps 16 on one grenade 15 in grenade working jig 70 and placing another grenade 15 in holding jig 80. Check to determine that tandem air tool 75 has been calibrated according to the procedure "Banding Machine Calibration with A500". Using gauge 76, check to see that the proper band clamping force is exerted on the single band clips A and double band buckles B, see FIGS. 1, 2, and 4. Remove the two grenades 16 from jigs 70 and 80 and, using a tensile force gauge, check to see that the slip force of grenades 15 lines 64*a* and 65*a* is acceptable and that the strength members are not being cut. Record the results of the calibration or verification steps now and throughout the assembly procedure. This recording of the results helps establish guides for quality control.

Details of this invention will be more thoroughly described with respect to more specific examples which follow. Spools 64 and 65 contain two 95-foot segments of nylon line 64*a* and 65*a* and are placed on shaft 62 of motor assembly 60. Lines 64*a* and 65*a* from spools 64 and 65 are tensioned at between 0.25 and 0.50 pounds. Air motor 61 is turned OFF and lines 64*a* and 65*a* are fed through assembly table tube 67.

Since grenades 15 are to be clamped onto lines 64*a* and 65*a*, 65 to 75 pairs of band clamps 16 are placed on tube 67. Band clamps 16 are kept together as pairs by a strap which joins individual clamps 16 together. Extra pairs of band clamps 16 may be needed in case one or more are damaged during assembly. Band clamps 16 are stainless steel clamps marketed as Band-It (P/N X201) by Band-It Corp., see FIG. 4.

In addition, male connector element 19 and female connector element 20 are to be secured to strength members 17 and 18 with connector clamps 21' and 21". Accordingly, 8 to 12 connector clamps 21 are placed on tube 67 since extra clamps may be needed in case one or more are damaged during assembly. Connector clamps 21' and 21" are stainless steel clamps commercially marketed as Band-It (P/N X295) by Band-It Corp.

Visually inspect band clamps 16 and connector clamps 21' and 21" to ensure that clip A is between the second and third layers and that buckle B is around all layers. Slide clamps 16, 21' and 21" over the assembly table tube 67 so that tails C are on the bottom of tube 67 and are pointing in toward the center of table 50.

Remove the two grenades 15 from holding jig 80 and grenade working jig 70 that were used for the calibration and/or clamping requirements testing. Again check to see that tandem air tool 75 has been calibrated according to the A500 procedure. Again check to see that the proper band clamping force will be exerted on clips A and buckles B. Again check to see that the slip force of the grenades on the strength members will be acceptable and that there will be no cutting of the strength members. Check to see that the red stripes on the sides of lines 64*a* and 65*a* indicate that the lines are not being twisted.

Pull about 30 inches of lines 64*a* and 65*a* past grenade working jig 70. Mark both lines 64*a* and 65*a* with a marker at the 30-inch length. This length is necessary for assembly of one of the connectors, as described above. Make certain that the red threads on the lines are visible and straight.

Now, grenade 15 is placed in grenade working jig 70 and will be clamped to lines 64*a* and 65*a*. Tails C of a pair of band clamps 16 extend into slots 72 of jig 70 and are inserted into tandem air tool 75. Segments of lines 64*a* and 65*a* are fed through band clamps 16 in grenade working jig 70 until the 30-inch mark is centered between the two clamps. Place the lines in longitudinal channels 71*a* on jig 70. Again see that the lines are not twisted by checking on the stripe orientation. Place air motor to TAKE-UP position. Hang the tension weight from the lines to ensure even tension on each line. Tandem air tool 75 draws in tails C of band clamps 16 to a proper clamping force and automatically cuts off tails C.

Turn air motor 61 off. Inspect the clamped grenade 15 for the orientation of clip A and buckle B of each band clamp 16 with respect to each line 64*a* and 65*a* and inspect the gaps between clips A and buckles B using a spacing gauge. Inspect that the cut lengths of tails C are 0.010 inches. Inspect lines 64*a* and 65*a* for anomalies, such as fraying or bulging, twisting, or cut filaments. If the clamps or lines fail to meet any of these requirements, remove the deficient clamp using a clamp remover, such as the Band-It J700. If the lines cannot be repaired by rolling the bulge out between two fingers, disassemble the assembled line charge and start over with new lines. If, however, the lines are undamaged and this section of the lines has only been clamped once before, repeat the grenade mounting step described above.

Male connector element 19 now may be attached by hand, if desired. Measure on the 30-inch end of the lines 64*a* and 65*a,* 13.125 and 13.925 inches from the middle of the first grenade 15 and make a mark. Take two connector clamps 21' and 21" (P/N X295) to secure male connector element 19 to lines 64*a* and 65*a*, and place one connector clamp 21' into a clamping hand tool. One hand tool for clamping that works is known as the POK-IT hand tool, made by Band-It Corp.

Feed the two 30-inch segments of lines 64*a* and 65*a* through the one connector clamp 21' in the POK-IT hand tool. Align the 13.125-inch mark with the back of male connector 19. Locate connector clamp 21' so that the rear of the clamp is at the 13.925-inch mark. Set the torque on the POK-IT hand tool at 135+/−5 inch-pounds, and torque the POK-IT hand tool until 135+/−5 inch-pounds has been reached. Bend tail C to 90 degrees from buckle B, and cut the excess tail C with shears being sure to leave 0.700+/−0.050 inches from buckle B. Bend the end of the excess band in toward itself with a needle-nose pliers until the end touches the band, and crimp the excess band against the buckle to form a smooth surface. The crimp must be past the edge of buckle B and the height from the top of buckle B to surface of connector element 19 is no more than 0.3 inches.

Insert second connector clamp 21" into the POK-IT hand tool. Bring lines 64*a* and 65*a* back toward the rear of male connector 19 and install the second connector clamp 21" over both lines. Locate second connector clamp 21" so that its rear is 0.40+/−0.06 inches from the end of male connector element 19, and buckles B from the first and second connector clamps 21' and 21" are within 45 degrees of each other. Set the torque on the POK-IT hand tool at 135+/−5 inch-pounds, and torque the POK-IT hand tool until 135+/−5 inch-pounds has been reached. Next, bend tail C of second connector clamp 21" to 90 degrees from buckle B and cut the excess tail C with shears to leave 0.700+/−0.050 inches from the buckle. Bend the end of the excess band in toward itself with a pliers until the end touches the band, and crimp the excess band against buckle B form a smooth surface. Ensure the crimp is past the edge of buckle B and the height from the top of buckle B to the surface of connector element 19 is no more than 0.3 inches.

The clamped male connector 19 should have both buckles B orthogonally disposed with respect to lines 64*a* and 65*a* and radially disposed within 45 degrees to one another. The top of both buckles B to the top of connector element 19 should measure no more than 0.30 inches. Again, inspect lines 64*a* and 65*a* for fraying or bulging. If a connector clamp or line fails to meet any of these requirements, remove the clamp using a clamp remover, such as the model Band-It J700 clamp remover, marketed by Band-It Corp. Inspect the lines for anomalies, such as bulging, twisting, or cut filaments, and if they cannot be repaired by rolling the bulge out between two fingers, disassemble the line charge assembly and start over with new lines. If the lines are undamaged and this section of the lines has only been clamped once before, simply repeat the assembly steps above.

After connector 19 is attached, tape two short sections of lines 64*a* and 65*a* near connector clamps 21, and measure one inch away from one buckle B along the lines and cut them.

Male connector element 19 also may be connected with a pneumatic tool, such as air tool 95. Again, measure on the 30-inch end of the lines 64*a* and 65*a,* 13.125 and 13.925 inches from the middle of the first grenade 15 and make a mark. Two connector clamps 21' and 21" (P/N X295) are used to secure male connector element 19 lines 64*a* and 65*a*. Place one connector clamp 21' into air tool 95. Feed the two 30-inch segments of lines 64*a* and 65*a* through connector clamp 21' in air tool 95. Align the 13.125-inch mark with the back of male connector element 19, and locate connector clamp 12' so that the rear of the clamp is at the 13.925-inch mark. Slowly press the pedal of the foot control valve of air tool 95 until it completes the entire cycle and automatically cuts off the tail.

Insert second connector clamp 21" into the pneumatic tool slot of air tool 95. Bring lines 64*a* and 65*a* back toward the rear of male connector element 19 and install second connector clamp 21" over both lines. Locate connector clamp 21" so that its rear is 0.40+/−0.06 inches from the end of male connector element 19. Slowly press the pedal of the foot control valve of air tool 95 until it completes the entire cycle and automatically cuts off the tail.

Male connector element 19 will have both buckles B orthogonally oriented with respect to lines 64*a* and 65*a* and radially disposed within 45 degrees of one another. The top of both buckles B to the top of connector element 19 will measure no more than 0.10 inches. Lines 64*a* and 65*a* are inspected for fraying or bulging. If a connector clamp or line fails to meet any of these requirements, the clamp is removed using a clamp remover, such as the Band-It J700 clamp remover. The lines are inspected for anomalies, such as bulging, twisting, or cut filaments, and if they cannot be repaired by rolling the bulge out between two fingers, the line charge assembly is disassembled and the procedure is restarted with new lines. If the lines are undamaged and this section of the lines has only been clamped once before, simply repeat the assembly steps above.

After connector element 19 is attached, tape two short sections of lines 64*a* and 65*a* near connector clamps 21. Then measure one inch away from one buckle B along the lines and cut them.

The previously clamped grenade 15 is placed and secured in recess 81 of holding jig 80, and tension on lines 64*a* and 65*a* is applied via motor 61. Replace an unconnected grenade 15 in the two halves of grenade working jig 70. Lines 64*a* and 65*a* are properly placed in longitudinal channels 71*a* across grenade holding jig 70. Make certain lines 64*a* and 65*a* are not twisted by inspecting the lay of the red threads in both lines.

Tails C of the next pair of band clamps 16 are inserted into the open slots of tandem air tool 75 and its air motor 61 is turned to the TAKE-UP position. While lines 64*a* and 65*a* are so held within holding jig 80, tandem air tool 75 is activated until it completes its entire cycle of band tightening and automatically cuts off tails C of both band clamps 16.

The air motor 61 of the air driven motor 60 is turned to the OFF position, and grenade 15 which has just been clamped to lines 64*a* and 65*a* is inspected. This inspection includes examination of: 1) proper aligned orientation of both band clamps' buckles B with regards to each line, 2) gaps between buckle B and clip A of each band clamp 16, 3) height of the cut tails C to 0.010 inches, and 4) lines 64*a* and 65*a* for fraying or bulging. If the band clamps fail to meet any of the requirements, the clamps are removed using the Band-It J700 clamp remover. If anomalies, such as bulging, twisting, or cut filaments of lines 64*a* and 65*a* cannot be repaired by rolling the bulge out between two fingers, disassemble the line assembly and start over with new lines. If the lines are undamaged and this section of the lines has only been clamped once before, repeat the assembly procedure of above.

If the clamp orientation of the clamped grenade is correct, place grenade 15 that was in grenade holding jig 80 into a collection box, and again check that there are no twists in the lines. The above procedure is repeated until all grenades have been clamped onto lines 64*a* and 65*a*.

At this point in the fabrication procedure female connector element 20 may be attached using a hand tool. Measure 4.985 and 6.285 inches along nylon lines 64*a* and 65*a* from the middle of the last grenade 15 of line charge 10 that was clamped onto the lines and make marks. Pull the remaining lengths of lines 64*a* and 65*a* from spools 64 and 65. Place a first connector clamp 21' (P/N X295) into the POK-IT hand tool, and feed the end lengths of lines 64*a* and 65*a* through this connector clamp 21' in the POK-IT hand tool. Align the 4.985-inch mark on the lines with the back of female connector element 20. Locate connector clamp 21' so that its rear is at the 6.285-inch mark on the lines. The torque setting on the POK-IT hand tool is set to 135+/−5 inch-pounds, and it is torqued until 135+/−5-inch pounds has been reached so that connector clamp 21' grips the lines and the female connector element. Bend the tail C of connector clamp 21' to 90 degrees from buckle B, and cut excess tail C with shears being sure to leave 0.700+/−0.050 inches from buckle B. Bend the end of the excess band in toward itself with needle-nose pliers until the end touches the band, and crimp the excess band against the buckle with the pliers to form a smooth surface. Ensure the crimp is past the edge of buckle B and the height from the top of buckle B to the surface of female connector element 20 is no more than 0.3 inches.

Second connector clamp 21" is inserted into the POK-IT hand tool, and lines 64*a* and 65*a* are brought back toward the rear of female connector 20. Connector clamp 21" is placed over both lines with the rear of the clamp 0.90+/−0.06 inches from the end of female connector element 21, and two buckles B are within a 45-degree arc of each other.

Set the torque on the POK-IT hand tool to about 135+/−5 inch-pounds, and apply the POK-IT hand tool until 135+/−5 inch-pounds has been reached so that connector clamp 21" grips lines 64*a* and 65*a* and female connector element 20. Bend tail C of connector clamp 21" to 90 degrees from its buckle B, and cut excess tail C with shears being sure to leave 0.700+/−0.050 inches from the buckle. Bend the end of the excess band in toward itself with a needle-nose pliers until the end touches the band. Crimp the excess band against the buckle with the pliers to form a smooth surface. Ensure the crimp is past the edge of buckle B and the height from the top of buckle B to surface of female connector element 20 is no more than 0.3 inches.

Inspect that the clamped female connector element 20 has buckles B from connector bands 21' and 21" properly oriented with respect to each of lines 64*a* and 65*a* and that buckles B are within a 45-degree arc of one another. Make certain that the height of the two buckles B is no more than 0.30 inches. If the connector clamps fail to meet any of the requirements, the clamps are removed using the Band-It J700 clamp remover. If bulging, twisting, or cut filaments of lines 64*a* and 65*a* cannot be repaired by rolling the bulge out between two fingers, disassemble the line assembly and start over with new lines. If the lines are undamaged and this section of the lines has only been clamped once before, repeat the assembly procedure of above.

Tape the two short sections of lines 64*a* and 65*a* near connector clamps 21' and 21", and cut them 1 inch from the nearest buckle B. Install spring clip 20*a*' in female connector element 20, see FIG. 5.

Female connector element 20 may also be installed with a pneumatic tool, air tool 95. Measure 4.985 and 6.285 inches along nylon lines 64*a* and 65*a* from the middle of the last grenade 15 that was clamped onto the lines and make marks. Pull the remaining lengths of lines 64*a* and 65*a* from spools 64 and 65.

Place one connector clamp 21' (P/N X295) in the slot of air tool 95, and feed the end lengths of lines 64*a* and 65*a* through this connector clamp 21' in air tool 95. Align the 4.985-inch mark on the lines with the back of female connector element 20. Locate connector clamp 21' so that its rear is at the 6.285-inch mark on the lines. While lines 64*a* and 65*a* are within air tool 95, it is activated until it completes its entire cycle of band tightening and automatically cuts off tail C of connector clamp 21' and discards it.

Second connector clamp 21" is inserted into the slot of air tool 95, and lines 64*a* and 65*a* are brought back toward the rear of female connector element 20. Second connector clamp 21" is placed over both lines so that the rear of the clamp is 0.90+/−0.06 inches from the end of female connector element 20 and the two buckles B are within a 45-degree arc of each other. While lines 64*a* and 65*a* are so disposed, air tool 95 is activated until it completes its entire cycle of band tightening and automatically cuts off tail C of connector clamp 21" and discards it.

Female connector element 20 which has just been clamped to lines 64*a* and 65*a* with connector clamps 21" and 21" is inspected. This inspection includes examination of: 1) proper aligned orientation of both connector clamps' buckles B with regards to each line, 2) gaps between buckle B and clip A of each connector clamp 21' and 21", 3) height of the cut tails C to 0.010 inches, and 4) lines 64*a* and 65*a* for fraying or bulging. If connector clamps 21' and 21" fail to meet any of these requirements, the deficient clamps are removed using the Band-It J700 clamp remover. If bulging, twisting, or cut filaments of lines 64*a* and 65*a* cannot be repaired by rolling the bulge out between two fingers, disassemble the line assembly and start over with new lines. If the lines are undamaged and this section of the lines has only been clamped once before, repeat this assembly procedure.

Tape the two short sections of lines 64*a* and 65*a* near connector clamps 21' and 21", and cut them 1 inch from the nearest buckle B. Install spring clip 20*a*' in female connector element 20 to join it to a mating connector portion, which could be male connector element 19 connected to, for example, another line charge 10. FIG. 5 shows such a joinder that properly positions components of connector elements 19 and 20 to assure critical spacings, or separation distances between ends 23' of detonating cords 23 or boosters 23*a*.

Referring to FIGS. 5 and 6, preparation of detonating cord 23 calls for placing threaded end caps 24, washers 25, nylon plates 26, nylon cups 27 and cast plugs 28 on both ends of detonating cord 23. Detonating cord 23 extends from one end to the other of line charge 10 being assembled. This part of the assembly procedure has been described above and can be performed before or after detonating cord 23 has been fed through axial bores 15*a* of all grenades 15 that have been clamped to nylon lines 64*a* and 65*a*.

If connection of elements 24, 25, 26, 27, and 28 is to be done before feeding detonating cord 23, axial bores 15*a* in grenades 15 must be large enough to allow these elements to pass through them. If axial bores 15*a* are not large enough, then elements 24, 25, 26, 27, and 28 are connected after detonating cord 23 is fed through axial bores 15*a*.

After the pull tests of cups 27 and plugs 28 on detonating cord 23 have been completed, thread end caps 24 as far as plugs 28 will allow into mating threads in male and female connector elements 19 and 20. When caps 24 are firmly tightened in the threads, ends 23' of detonating cord 23 will be properly secured and placed in connector elements 19 and 20 to assure transfer of detonation between them.

Place the partially assembled line charge that includes grenades 15, male and female connector elements 19 and 20, and lines 64*a* and 65*a* on pack out table 100. Male and female connector elements 19 and 20 and grenades 15 are placed with buckles B down and detonating cord 23 passes through grooves 125 on humps 120. Lines 64*a* and 65*a* lie straight on opposite sides of humps 120. Both lines 64*a* and 65*a* and detonating cord 23 are not twisted as they lie on pack out table 100. If the length of lines 64*a* and 65*a* between adjacent grenades 15 appears to be short, measure to verify that the length is 16.375+/−0.125 inches. If the length falls outside of this range, correct the discrepancy by removal and relocation of the misplaced grenades 15.

The length of detonating cord 23 is noted. The overall length of detonating cord 23 is allowed to vary by +/−3 inches. Humps 120 may be added or subtracted to bring the length of detonating cord 23 as determined below to within this range. Humps 120 are to be added or removed in pairs (one at each and) until the excess slack has been accounted for. This aspect of management of slack in detonating cord 23 should be verified before marking the detonating cord.

The spacing of contoured humps 120 may vary and will be controlled in accordance with the following dimensions: the spacing between grenades 1 and 10 and the spacing between grenades 50 and 60 will be 19.00+/−0.25 inches; the spacing between grenades 10 and 50 will vary depending on the detonating cord slack; and 17.40+/−0.25 inch humps will be added (two at a time with one being at one end and the other at the opposite end) until all of the slack has been accounted for.

Starting at the end with male connector 19, hold detonating cord 23 down in groove 125 of first hump 120 and mark it, 0.25 inches on each side of first grenade 15 with a red marker. Continue to hold and mark detonating cord 23 at this distance from each grenade 15 along the entire length of line charge 10 taking care not to move the portion of detonating cord 23 that has already been marked.

Check once again to see the 0.25-inch marks along detonating cord 23 are on both sides of each grenade 15, and there is no fraying or bulging of detonating cord 23 or lines 64*a* and 65*a*.

A stowage container for the finished line charge 10 is most likely a backpack container that is placed on a pack out cart. The cart and backpack are moved along pack out table 100 to a position next to female connector 20 and first clamped grenade 15. As connector elements 19 and 20, grenades 15, lines 64*a* and 65*a*, and detonating cord 23 are packed as described below, the cart progresses in a direction that is parallel along the length of pack out table 100. This orderly progression further prevents twisting or entanglement of components as the entire line charge is packed.

Line charge 10 is started to be packed in the backpack from the end where female connector element 20 is attached. This will be the end where the launch tube holder for the rocket motor will be. The launch tube holder is pointed in a direction away from the technician packing the line charge. The first grenade 15 is placed on its end in the left-hand corner of the backpack and female connector element 20 is positioned to hang out over the edge of the backpack. The second grenade 15 is placed in the center of the backpack with its buckles B down and near the side of the backpack that is opposite where the launch tube holder was put. Successive ones of grenades 15 are similarly placed in the bottom with their buckles B down also.

After the twenty-fifth grenade 15 has been put in the backpack, visually inspect each grenade 15 for the 0.25-inch marks to ensure that slack in detonating cord 23 was maintained. If any of the marks are not visible, adjust detonating cord 23 until all the marks are visible. All of the excess lines 64*a* and 65*a* and detonating cord 23 are folded into the center of the layer of grenades 15, taking care not to loop lines 64*a* and 65*a* or detonating cord 23 around any grenade 15, and taking care not to twist the assembled line charge 10.

Pack the middle or second layer of line charge 10 into the backpack container with buckles B down. After the forty-sixth grenade 15 has been placed into the backpack, visually inspect all grenades 15 for the 0.25-inch marks to be sure that proper slack in detonating cord 23 was maintained. If all marks are not visible, adjust detonating cord 23 until all marks are visible.

Again, fold all of the excess of lines 64*a* and 65*a* and detonating cord 23 into the center of this layer taking care not to loop the lines or detonating cord around any grenade 15 and also taking care not to twist the assembled line charge.

A cushion is placed over this middle or second layer in the backpack to extend to the diagonal cut out which is positioned for the first grenade 15, and nothing else under the cushion is visible. The top or third layer of the line charge is packed into the backpack container with buckles B of grenades 15 facing down.

After all grenades 15 have been packed into the backpack, male connector 19 now is placed to hang over the edge of the backpack. Visually inspect each grenade 15 of the third level of grenades 15 for the 0.25-inch marks to ensure that slack in detonating cord 23 was maintained. If all marks are not visible, adjust detonating cord 23 until all of the marks are visible. Again, fold all of the excess of lines 64*a* and 65*a* and detonating cord 23 into the center of the third layer, taking care not to loop the lines or detonating cord around any grenade 15, and taking care not to twist the assembled line charge 10.

A cushion is placed over the top or third layer in the backpack. A diagonal cut out in the cushion is positioned to expose the first grenade 15, and nothing else under the cushion is visible. Male and female connector elements 19 and 20 are placed on top of the cushion. At this time again verify that the flush-to-0.010-below flush requirement is met for both ends 23' of connector elements 19 and 20.

Female connector element 20 on the top layer of the cushion is attached to male connector element 19 without unpacking or entangling the line charge. The presence of retaining spring clip 20*a*' is verified to be in female connector element 20. At this time also place the launch tube on the cushion on the diagonal with the small end pointing toward female connector element 20.

The backpack lid is replaced over the backpack. Care must be taken to see that no parts of detonating cord 23 or lines 64*a* and 65*a* are sticking out of the sides. Finally, the lid is secured using the latch assemblies on the sides of the backpack.

The advantages of the apparatus and procedure of this invention are numerous. Holding jig 80 and grenade working jig 70 are spaced apart to ensure proper spacing of grenades 15 along line charge 10. Holding jig 80 assures that adequate tension will be imparted to lines 64*a* and 65*a* via motor assembly 60. This minimizes slack and provides for accurate and repeatable spacing of grenades 15. The red thread or stripe running along one side of both lines 64*a* and 65*a* helps eliminate performance degrading twisting of the lines during fabrication since it allows a continuous visual inspection of the lines' condition throughout the assembly process. The pneumatic air tools 75 and 95 perform repeatable clamping and cutting during tightening of band clamps 16 and connector clamps 21' and 21", and the tools may be calibrated before being used. Use of the reliable air tools 75 and 95 for the clamping operations further reduces human errors associated with other human powered clamping tools. Connector jig 90 facilitates repeatable and easy clamping of lines 64*a* and 65*a* on male and female connector elements 19 and 20. The use of hand held gauges and other measuring devices permits on the spot inspections of the proper orientation of clamps, lines, and grenades and the associated crimping, or clamping forces. Pack out table 100 allows for easy and accurate integration of detonating cord 23 into the rest of the components of line charge 10. The use of pack out table 100 with two-part cylindrically-shaped mold 29' and 29" assures proper alignment of and tolerances for ends 23' of detonating cord 23 in male and female connector elements 19 and 20. Spaced-apart wells 110 on pack out table 100 help maintain proper spacing of grenades 15, and grooves 125 in humps 120 properly manage slack in detonating cord 23. Humps 120 also help in management of slack in detonating cord 23 by helping to eliminate twisting as the fairly rigid detonating cord is laid into the final packing arrangement of line charge 10.

Line charge 10 flies and/or detonates properly because its construction is not faulty. The faulty construction of some other line charge systems leads to their failure after they have been subjected to the rigors associated with transportation and set up, and the severe stresses and strains created during deployment under combat conditions.

Line charge 10, manufactured according to this inventive concept, is lightweight and maintains spacing tolerances between adjacent grenades 15 that are critical for their effectiveness. Line charge 10 provides reduced strain loading relative to detonating cord 23 which transfers detonation to grenades 15. Thus, line charge 10 made according to this invention can accommodate the strains encountered during deployment and does not create uneven forces which might cut or break the anchorage and strength members 17 and 18 while maintaining correct spacing between adjacent grenades 15.

Line charge 10 may be the MK7 Anti-Personnel Obstacle Breaching System (APOBS) which is in inventory with some units of the U.S. Armed Forces. It is reliably deployed and detonated because it is made according to the novel and unique assembly procedure and apparatus of this invention which assures quality controlled and uniform construction.

The disclosed components and their arrangements as disclosed herein all contribute to the novel features of this invention. The novel features of this manufacturing process and means for manufacturing assure more reliable and effective use of different line charges 10 for clearing safe passageways across different terrains that have diverse collections of obstacles and mines.

The components of line charges 10 might necessarily have to be tailored for different tasks, yet such modifications will be within the scope of this inventive concept. For example, in accordance with this invention, line structures other than nylon could be used; clamp structures other than the disclosed stainless steel, multi-banded, clipped and buckled designs could be used; and different configurations of line charges could be manufactured that have smaller or larger grenades 15 spaced closer or further apart to match the anticipated breaching tasks. Differently shaped grenades 15 having different explosives could be substituted to suit the mission. Bigger or smaller strength members 17 and 18 and different structures for detonating cord 23 might also be selected for the different tasks. These components can be incorporated into the fabrication procedure of this invention to better accommodate different mission requirements without departing from the scope of this invention.

Furthermore, having this disclosure in mind, one skilled in the art to which this invention pertains will select and assemble other suitable components in different configurations. For example, line charge 10 may have more strength members 17 and 18 equidistantly spaced around and secured to grenades 15. Therefore, the disclosed method and means for manufacturing are not to be construed as limiting, but rather, are intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. An apparatus for assembling a line charge comprising:

means for exerting tension on elongate lines;

means for holding a grenade secured to said lines to resist said tension;

means interposed between said tension exerting means and said holding means for clamping grenades to said lines;

means interposed between said tension exerting means and said holding means for securing connector elements to ends of said lines;

means receiving the grenades clamped to said lines for spacing said clamped grenades predetermined distances apart in wells;

means interposed between said wells for creating slack lengths of a detonating cord between said spaced clamped grenades; and means for securing opposite end portions of said detonating cord to said connector elements.

2. An apparatus according to claim 1 further comprising:

means adjacent said tension exerting means for feeding said lines therethrough and for supporting band clamps and connector clamps.

3. An apparatus according to claim 2 further comprising:

an assembly table mounting said tension exerting means, said holding means, said grenade clamping means, and said connector securing means; and a pack-out table mounting said spacing means and said slack length creating means.

4. An apparatus according to claim 3 further including:

means for providing cast plugs connected to said end portions of the detonating cord for said connector elements.

5. An apparatus according to claim 4 in which each cast plug is molded in a cup, onto said end portions of the detonating cord and to a plate adjacent an end cap to engage each connector element and hold one end of said detonating cord within a critical spacing distance of the end of each connector element.

6. An apparatus according to claim 5 in which said assembly table permits inspection of stripes disposed on said lines to indicate anomalies of said lines, and said pack out table allows said detonating cord to extend through axial bores in said clamped grenades and permits inspection of said stripes and said detonating cord to indicate anomalies and to indicate sufficient distribution of slack in said detonating cord.

7. An apparatus according to claim 6 in which each said tension exerting means includes a motor mounting a shaft supporting spools of said lines, said motor being adjustable to exert and maintain said tension, and said feeding and supporting means is an elongate tube mounted above said assembly table to pass said lines through it and carry said band clamps and connector clamps on it.

8. An apparatus according to claim 7 in which said holding means is a holding jig configured to receive and engage a clamped grenade to thereby resist said tension, and said clamping means includes a grenade working jig shaped to receive a grenade and said lines to allow said band clamps to be crimped onto said grenade in said working jig and said lines.

9. An apparatus according to claim 8 in which said clamping means further includes a clamping tool to engage tails of said band clamps through slots in said grenade working jig to crimp said band clamps onto said grenade in said working jig and said lines.

10. An apparatus according to claim 9 in which said end connector securing means includes a connector working jig shaped to receive a connector element and said lines to allow said connector clamps to be crimped onto said connector element in said connector working jig and said lines.

11. An apparatus according to claim 10 in which said connector working jig is provided with slots to receive tails of said connector clamps to be engaged with said clamping tool to crimp said connector element in said connector working jig onto said lines.

12. An apparatus according to claim 11 in which said spacing means is a series of equidistantly spaced-apart wells each having a separate clamped grenade therein.

13. An apparatus according to claim 12 in which said slack creating means is a series of hump-shaped contoured surfaces that each have a longitudinal groove to guide and create slack lengths of the detonating cord between said spaced-apart clamped grenades.

14. A line charge assembly structure comprising:

a motor to exert tension on elongate lines extending from spools;

a holding jig to engage a grenade secured to said lines to resist said tension;

a grenade working jig interposed between said motor and said holding jig having a recess to position a grenade therein and having a tool to clamp grenades to said lines;

a connector jig interposed between said motor and said holding jig having a recess to receive a connector element therein and having a tool to clamp a separate connector element to opposite ends of said lines;

a series of spaced-apart grenade wells to each receive a separate grenade clamped to said lines therein;

a series of contoured humps each interposed between two wells, said humps each having a longitudinal groove to receive said detonating cord and create slack lengths of the detonating cord between the spaced clamped grenades and having said lines disposed on opposite sides; and cast plugs to secure opposite end portions of said detonating cord to each connector element at opposite ends of said lines.

* * * * *